US011338984B2

(12) United States Patent
Bidamant et al.

(10) Patent No.: US 11,338,984 B2
(45) Date of Patent: May 24, 2022

(54) CONTAINER FOR PACKAGING A FIRST FLUID COMPRISING A CAPSULE FOR PACKAGING A SECOND FLUID, AND A CAPSULE SUITABLE FOR SAID CONTAINER

(71) Applicants: CADORIT AG, Basel-Landschaft (CH); ESTEE LAUDER INC., New York, NY (US)

(72) Inventors: Florence Bidamant, Mulhouse (FR); David Bouteloup, Peymeinade (FR); Lorraine Drake, New York, NY (US); Robert Michael Crescas, Madison, NJ (US)

(73) Assignees: CADORIT AG, Basel-Landschaft (CH); ESTEE LAUDER INC., New York, NY (US)

( * ) Notice: Subject to any disclaimer, the term of this patent is extended or adjusted under 35 U.S.C. 154(b) by 233 days.

(21) Appl. No.: 16/615,386

(22) PCT Filed: May 23, 2018

(86) PCT No.: PCT/EP2018/063488
§ 371 (c)(1),
(2) Date: Nov. 20, 2019

(87) PCT Pub. No.: WO2018/215530
PCT Pub. Date: Nov. 29, 2018

(65) Prior Publication Data

US 2020/0156851 A1 May 21, 2020

(30) Foreign Application Priority Data

May 23, 2017 (FR) ..... 1754570

(51) Int. Cl.
*B65D 51/28* (2006.01)
*B65D 81/32* (2006.01)
*B65D 83/00* (2006.01)

(52) U.S. Cl.
CPC ..... *B65D 81/3222* (2013.01); *B65D 51/285* (2013.01); *B65D 51/2821* (2013.01); *B65D 83/0094* (2013.01)

(58) Field of Classification Search
CPC ..... B65D 83/0094; B65D 51/2807; B65D 51/2814; B65D 51/2821; B65D 51/2828;
(Continued)

(56) References Cited

U.S. PATENT DOCUMENTS 3,831,742 A * 8/1974 Gardella ..... A61C 5/66 206/219
4,103,772 A 8/1978 Wiegner
(Continued)

FOREIGN PATENT DOCUMENTS

CN 1735541 A 2/2006
CN 1273351 C 9/2006
(Continued)

OTHER PUBLICATIONS

First Examination Report for Chinese Application No. 201880033398.5 (dated Apr. 14, 2021).
(Continued)

*Primary Examiner* — Patrick M. Buechner
(74) *Attorney, Agent, or Firm* — Jenkins, Wilson, Taylor & Hunt, P.A.

(57) ABSTRACT

The subject matter described herein includes a container having a substantially tubular body forming a first volume for receiving a first fluid. The body includes a first and a second end, and the first end includes a dispenser provided with an aperture making it possible to dispense the contents
(Continued)

of the container. The second end includes a closure element having a flexible wall making it possible for the flexible wall to be displaced between a first and a second position relative to the dispenser in order to thus dispense the contents of the container. The container includes a capsule with an outer wall forming a second volume for containing a second fluid. The capsule is positioned between the dispenser and the flexible wall respectively. The capsule is suitable for releasing the second fluid into the first volume during or after a first displacement of the flexible wall from its first position towards its second position.

9 Claims, 4 Drawing Sheets

(58) Field of Classification Search
CPC ..... B65D 51/2835; B65D 51/2842; B65D 51/285; B65D 81/3222; A61C 5/66; A61J 1/2006; A61J 1/2027; A61J 1/2093; B01F 15/0205; B01F 15/0206; B01F 15/0212
See application file for complete search history.

(56) References Cited

U.S. PATENT DOCUMENTS 6,364,103 B1 * 4/2002 Sergio ..... A61L 2/18 141/330
7,721,880 B2 * 5/2010 Pearce ..... B65D 51/249 206/219
10,196,195 B2 * 2/2019 Guillon ..... B65D 81/32
2014/0246343 A1 * 9/2014 Sebille ..... B65D 1/40 206/222
2018/0319566 A1 * 11/2018 Pan ..... B65D 1/0207
2021/0316929 A1 * 10/2021 Bouteloup ..... B65D 81/3211

FOREIGN PATENT DOCUMENTS

FR 1159703 A 7/1958
FR 2 981 917 A1 5/2013
GB 1 270 673 4/1972
WO WO 02/092440 A2 11/2002
WO WO 2004/063254 A1 7/2004

OTHER PUBLICATIONS

Notification of Transmittal of the International Search Report and the Written Opinion of the International Searching Authority, or the Declaration for International Application No. PCT/EP2018/063488 (dated Sep. 13, 2018).
Notification of European Publication for Application Serial No. 03768413.1 (dated Aug. 31, 2005).
Notification of European Publication for Application Serial No. 02729031.1 (dated Jan. 23, 2004).

* cited by examiner

CONTAINER FOR PACKAGING A FIRST FLUID COMPRISING A CAPSULE FOR PACKAGING A SECOND FLUID, AND A CAPSULE SUITABLE FOR SAID CONTAINER

TECHNICAL FIELD

The present invention relates to a container comprising a substantially tubular body forming a first volume making it possible to receive a first fluid, said body being provided with a first and a second end, said first end comprising a dispenser provided with an aperture making it possible to dispense the contents of the container, said second end comprising a closure element, said closure element comprising a flexible wall to make it possible for said flexible wall to be displaced between a first and a second position with respect to said dispenser and thus distribute the contents of the container.

The invention relates more particularly to the field of packaging suitable for packaging cosmetics products and therapeutic products.

The container according to the present invention is suitable for packaging two fluids, in such a way that the two fluids are separate from one another. The first fluid can, for example, be in the form of a liquid, and the second can be a powder. Alternatively, the first and the second fluid can, for example, be in the form of two liquids. Other combinations of two fluids are also possible.

BACKGROUND

The prior art discloses several containers which make it possible for a first and a second fluid to be packaged in the same container, whilst ensuring the separation between the first fluid and the second fluid.

These containers are equipped with a striker, which can be used at a moment chosen by the user, making it possible to remove the separation between the two fluids, thus permitting the mixing of the two fluids and obtaining a ready-to-use substance.

A container of this type is described in the American patent U.S. Pat. No. 4,103,772. This document describes a container comprising two bodies which each take the form of a receptacle.

A first body includes a first end, provided with a dispenser, and a second end having an aperture for receiving a first fluid inside the first body. This first body can receive, at its second end, a second body which serves as a closure of this second end of the first body.

The second body, for its part, includes a first end forming an inlet making it possible to receive a second fluid, this end being able to be closed by a rupturable membrane. The second end of this second body includes a flexible wall equipped with a movable striker in order to be able to displace, at a moment chosen by the user, said striker from a first position referred to as a "rest position" towards a second position which makes it possible to cut the rupturable membrane and permits the mixing of the first fluid, which is contained in the first body, and the second fluid, which is contained in the second body of the container.

In order to make it possible for the striker to move from the first position towards the second position, the flexible wall on which said striker is secured is relatively pliable. As indicated above, the second body, its flexible wall and the striker are produced within a single step using a single material. This material is, in the first instance, chosen in order to ensure the proper packaging of the second fluid inside the second body.

French patent application FR1159703 discloses a container making it possible to package a first and a second fluid, wherein said container comprises a flexible wall on which a striker has been secured. The device according to FR1159703 is characterised in that the material used for the flexible wall is different from the material used to obtain the striker. This means that the material which makes it possible to obtain the flexible wall is optimised for the function of said flexible wall so as to be displaced from a first position towards a second position. The material used for the striker has been optimised for the function aimed at striking a separation membrane between the first and the second fluid.

SUMMARY

The aim of the present invention consists in proposing an improvement of the containers as disclosed in the prior art in which the materials used for packaging the first fluid and the second fluid can be optimised.

The object of the present invention relates to a container comprising a substantially tubular body forming a first volume for receiving a first fluid, said body having a first and a second end, said first end comprising a dispenser provided with an aperture making it possible to dispense the contents of the container, said second end comprising a closure element, the closure element comprising a flexible wall making it possible for said flexible wall to be displaced between a first and a second position relative to said dispenser in order to thus dispense the contents of the container, wherein the container comprises a capsule with an outer wall forming a second volume for containing a second fluid, the capsule being positioned between the dispenser and the flexible wall respectively, the capsule being suitable for releasing the second fluid into said first volume during or after a first displacement of said flexible wall, from its first position towards its second position.

A first advantage of the container according to the present invention is that said container comprises a capsule suitable for receiving and containing the second fluid inside it. According to the containers described in the prior art, the second fluid is in direct contact with the striker and the flexible wall. If the fluid comprises a relatively corrosive product, the direct contact between the second fluid and the material used for the striker and the flexible wall respectively could have the effect of degrading the integrity of said striker or of said flexible wall. In addition, a potential chemical reaction between the second fluid and elements present in its immediate surroundings, such as oxygen or water, could compromise the functionality of the active agents making up said second fluid. These chemical reactions are possible due to the fact that the flexible wall is not sufficiently impermeable to protect the second fluid against the effects of elements such as oxygen or water.

The use of a capsule, forming a second volume for receiving and containing the second fluid, makes it possible to avoid any direct contact between said second fluid and the material of the striker and of the flexible wall until the first use of the container according to the present invention.

According to a preferred embodiment, the closure element is suitable for being secured to the inside of the tubular body, the body having a shoulder for limiting the insertion of the closure element into said body, and the capsule is suitable for being secured between said shoulder and the closure element respectively.

According to a preferred embodiment, the closure element is secured in the body by snap-fitting.

According to a preferred embodiment, the capsule comprises a first wall, suitable, in the assembled position of the capsule, for being positioned in the direction of the dispenser, and a second wall, suitable, in the assembled position of the capsule, for being positioned in the direction of the pliable wall of the closure element.

According to a preferred embodiment, the first wall of the capsule comprises a first material and the second wall comprises a second material, different from the first material. According to a preferred embodiment, the first material of the first wall of the capsule has a breaking-strength coefficient lower than that of the material of the second wall of the capsule.

According to a preferred embodiment, at least one part of the second wall of the capsule is provided with at least one frangible area.

According to a preferred embodiment, the container is provided with a striker suitable for following the displacement of the pliable wall from its first towards its second position and suitable for opening the first and the second wall of the capsule during this displacement.

According to a preferred embodiment, the striker is secured on the pliable wall and directed, in its assembled position, in the direction of the second wall of the capsule.

According to a preferred embodiment, the striker is secured to the inside of the capsule between the first and the second wall of the capsule.

According to a preferred embodiment, the striker is positioned substantially on the longitudinal axis of the body of the container, and the capsule has, in cross-section, substantially the shape of a W, with an outer compartment for filling the space around the striker and a central cavity suitable for cooperating with the striker.

According to a second aspect of the present invention, the invention relates to a capsule suitable for the container according to the invention.

BRIEF DESCRIPTION OF THE DRAWINGS

The invention will become more clearly apparent on reading the following description which refers to the corresponding figures which are depicted for illustrative and non-limiting purposes.

More precisely.

DETAILED DESCRIPTION

The present description uses the term "snap-fitting". Within the claims and the description of the figures, the term "snap-fitting" refers to the fact that a first element is introduced with force inside a second element, the securing of the first element to the second element being obtained with the aid of the elastic deformation of at least said first element or said second element.

The description and the claims refer to a "frangible" area. The present description uses the term "frangible" area referring to a particularly, and intentionally, weakened, location on a surface, in comparison with the rest of said "frangible" area. The location where an element deforms or fractures is predetermined by this "frangible" area.

Figure 1:
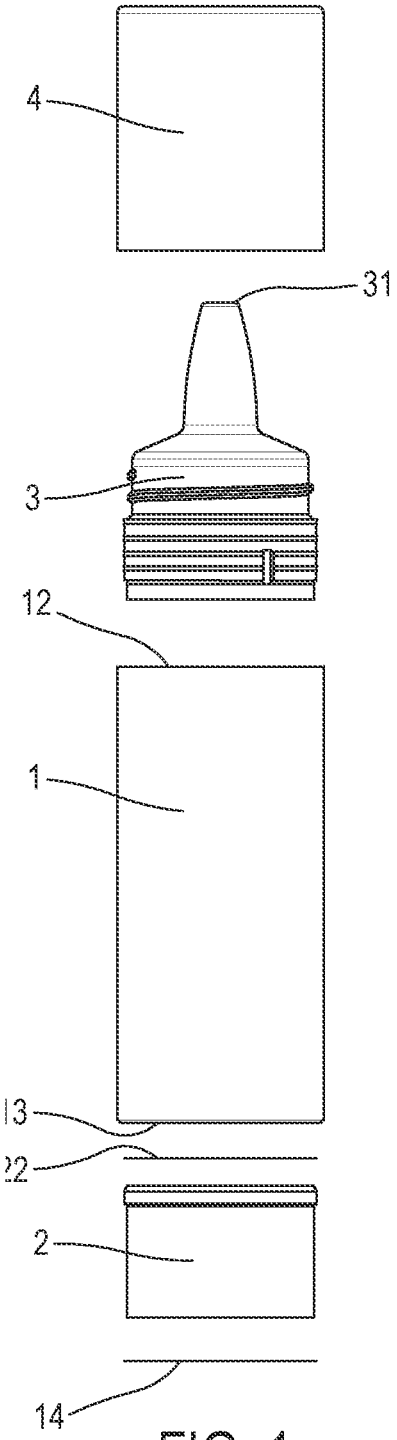
FIG. 1 (PRIOR ART)
FIG. 1 shows the different elements making it possible to obtain, after assembly, a container according to the prior art.
Figure 2:
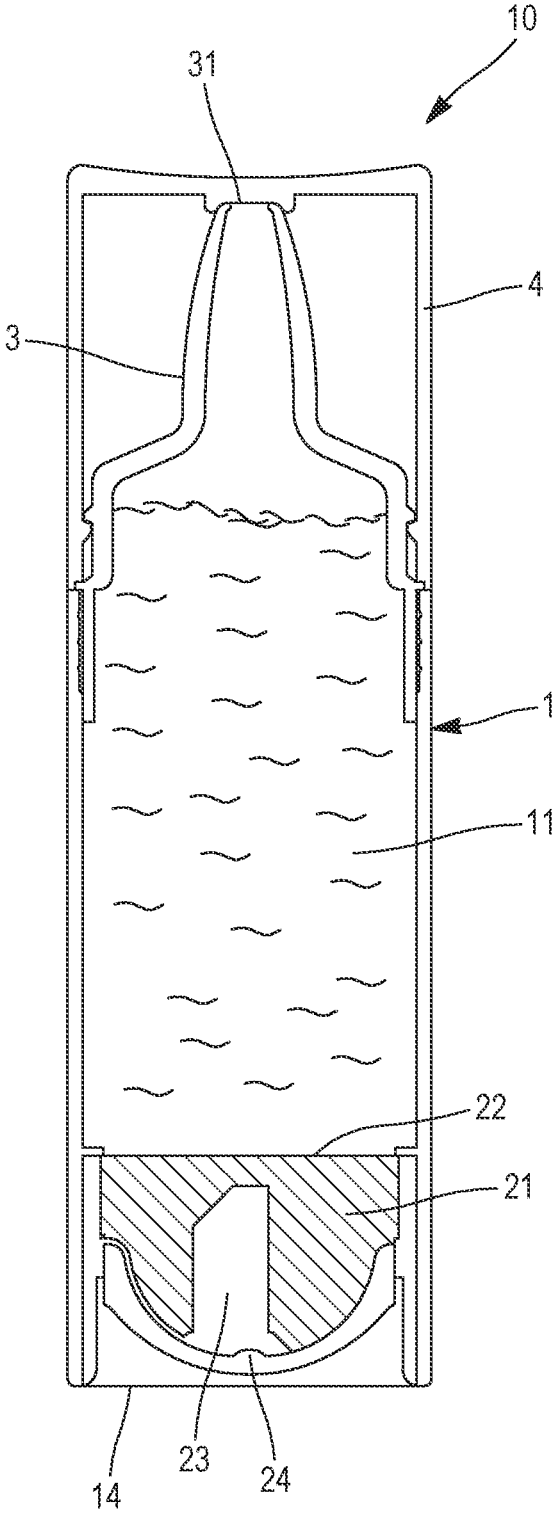
FIG. 2 (PRIOR ART)
FIG. 2 depicts a sectional view of the container according to the prior art, said container being filled with a first and a second fluid.

FIGS. 1 and 2 depict the container 10 according to the prior art, said container 10 including a first element or body 1, suitable for containing a first fluid 11, and a second element 2, suitable for containing a second fluid 21.

The first element 1 comprises a tubular body including a dispenser 3 at its first end 12. This dispenser 3 is provided with an outlet aperture 31 making it possible to disperse fluid towards the outside of the container 10. Before using the container 10, and in order to close the outlet aperture 31, a cap 4 is secured on the dispenser 3.

First of all, the second end 13 of the element 1 forms an aperture making it possible to fill the element 1 with a first fluid 11. Next, when the first fluid 11 is received inside the element 1, said second end 13 can be closed by virtue of the second element 2.

When the second element 2 is positioned inside the element 1, a membrane 14 can be secured on the second element 2, which membrane 14 has the function of protecting the container 10.

The second element 2 of the container 10 has the function of containing a second fluid 21 inside it. In order to prevent the first fluid 11 and the second fluid 21 from mixing before the container 10 is used, said two fluids 11 and 21 are separated by a membrane 22.

At a moment chosen by the user, the membrane 22 must be perforated in order to make it possible for the two fluids 11 and 21 to mix. The container 10 according to the present invention is provided with a striker 23 suitable for perforating the membrane 22, said striker 23 being secured on a flexible wall 24.

The use of the container 10 according to the prior art is accomplished in the following manner. If a user wishes to use the contents of the container 10 according to the invention, first of all he removes the membrane 14 in order to gain access to the walls 24. The user then uses one finger to exert a pressure on the wall 24, thus displacing the striker 23 which is displaced from its first position, as shown in FIG. 1, towards the membrane 22. The user can then exert a pressure on said membrane 22 to perforate the latter, thus making it possible to mix the two fluids 11 and 21.

After the perforation of the membrane 22, the user shakes the container 10 in order to ensure that the fluids 11 and 21 are optimally mixed. Following this operation, the user can remove the cap 4 and disperse the mixture by virtue of the aperture 31.

As shown in FIG. 2, in the container 10 according to the prior art, the second fluid 21 is in contact with the striker 23 and the flexible wall 24, prior to using said container 10. The advantage of the container, as depicted in FIGS. 1 and 2, is that a first fluid 11 and a second fluid 21 can be kept separate until the moment when the user decides to make use of said container 10. The separation of the fluids 11, 21 can make it possible to preserve the effectiveness of the active principles and ingredients of said fluids 11, 21 for as long as possible. This is certainly the case if the container is used to package cosmetics products and therapeutic products. In addition, it should be noted that the flexible wall 24 is not sufficiently impermeable to protect the second fluid 21 against the effects of elements such as oxygen or water, for example, which may be present in the surroundings of the container. A chemical reaction between the second fluid 21 and said elements, such as oxygen or water, could compromise the functionality of the active agents making up said second fluid 21.

It is entirely conceivable for the fluid 21 to contain corrosive elements. In this precise case, during transportation and storage of the container 10, the corrosive fluid could affect the quality and integrity of the striker 23 and of the flexible wall 24. The potential degradation of the striker 23 and of the flexible wall 24 considerably restricts the length of time available between the filling of the container 10 and its final use.

Figure 3:
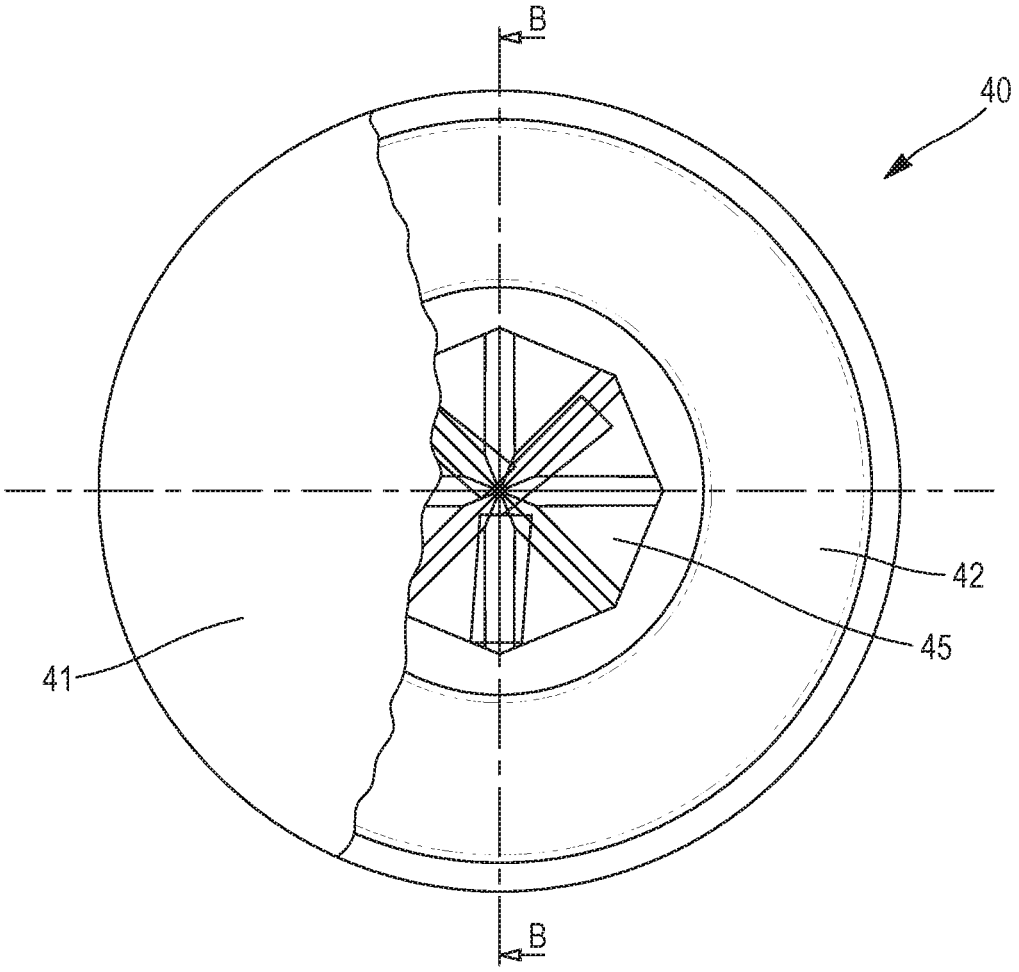
FIG. 3 shows a top view of the second part of the capsule according to the present invention.

FIG. 3 depicts a first embodiment of a capsule 40 according to the invention. The capsule 40 is composed of a first part or first wall 41, said first wall 41 being partially removed, for the sake of clarity, so as to show the inside of said capsule 40. Said first wall 41 is orientated in the direction of the dispenser of the container 10, when the capsule 40 is in the assembled position. The first wall 41 has the function of separating the first fluid 11, stored inside the body 1 of the container 110, from the second fluid 21, which is enclosed inside the capsule 40. The first wall 41 is secured on an edge of the second part or second wall 42 of the capsule 40. The second wall 42 of the capsule 40 has the form of a receptacle and constitutes, in combination with the first wall 41, a volume which makes it possible to receive and contain the second fluid 21. The second wall 42 is thus obtained, for example, with the aid of a moulding process by virtue of the use of a plastic selected to be compatible with the second fluid 21 which, for its part, is intended to be packaged in the capsule 40. The first wall 41, having the form of a protective cover, could be produced, for example, with the aid of aluminium.

Figure 4:
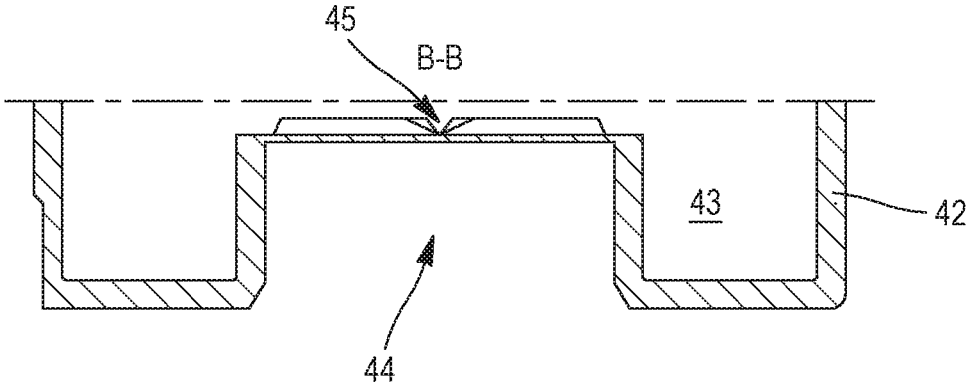
FIG. 4 depicts a sectional view of the second part of the capsule according to the present invention.

FIG. 4 depicts a sectional view along a section B-B, as shown in FIG. 3.

Figure 5:
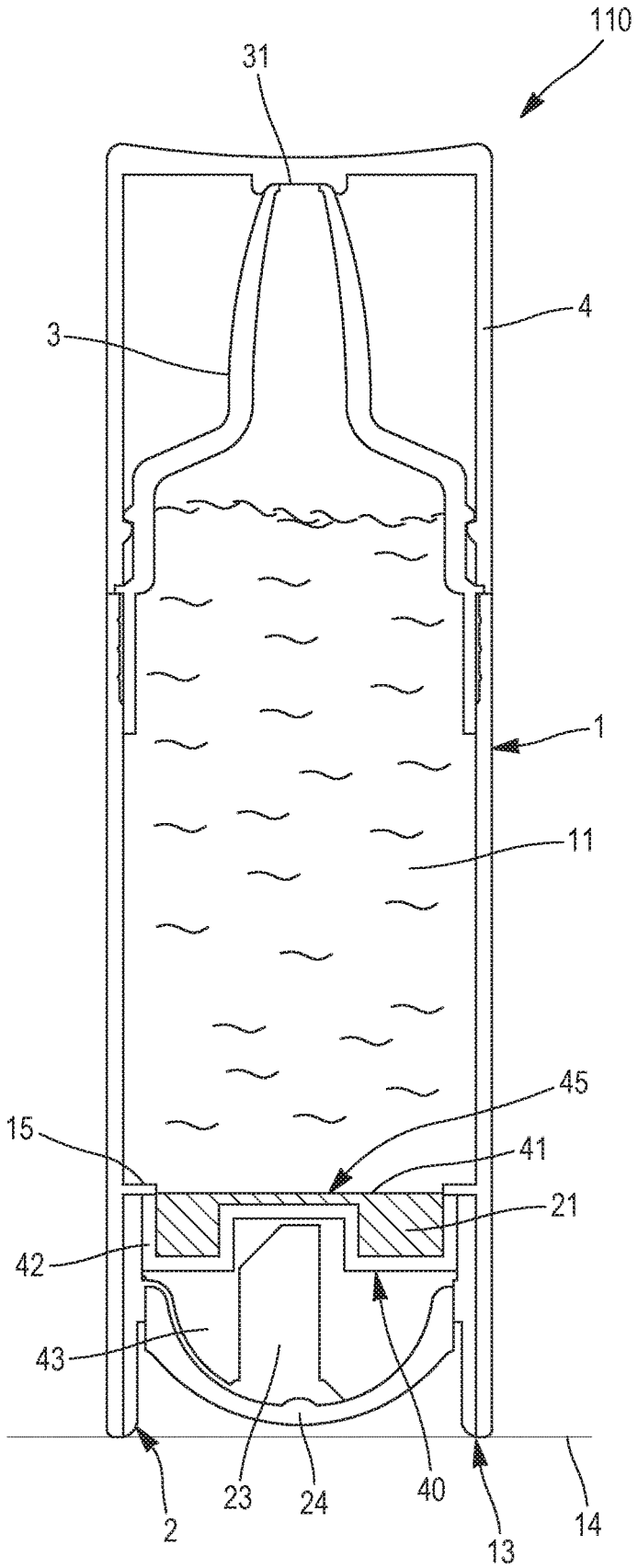
FIG. 5 shows a sectional view of the assembly of the capsule according to the invention in the closure element of the container according to the present invention.

The second wall 42 is as shown in FIGS. 3 and 4 and has a sectional view which depicts substantially the shape of a W. The inside of said second wall 42 constitutes an outer compartment or a substantially annular volume 43 making it possible to receive the second volume of the second fluid 21. The central part of the second part 42 forms a central cavity 44 suitable for cooperating with a striker 23 (as shown in FIG. 5). As shown in FIGS. 3 and 4, the central part comprises a frangible area 45, which frangible area comprises grooves, or other comparable elements, making it possible to locally weaken the rigidity of said second wall 42. The grooves, which together form the frangible area 45, have the aim of predetermining the location where the wall of the second wall 42 fractures, if a pressure of a certain value is exerted on said second wall 42 with the aid of the striker 23.

FIG. 5 depicts a container 110 according to the invention with a capsule 40 according to an assembled position. The capsule 40 is secured between the body 1 and the second wall 2.

More precisely, the body 1 comprises shoulders 15 making it possible to limit the insertion of the unit of the capsule 40 and the second wall 2 into the body 1. The capsule 40 comprises a certain quantity of a second fluid 21. FIG. 5 shows that the shape of the capsule 40 makes it possible to fill the space situated around the striker 23 with the aid of said second fluid 21. FIG. 5 also shows that the end of said striker 23 is positioned in such a way as to be close to the frangible area 45 of the second wall 42 of the capsule 40. The unit composed of the second part 2 and the capsule 40 is suitable for being introduced inside the second end 13 of the body 1. The outer wall of the second part 2 allows a shoulder or a protrusion (not shown) to appear, said protrusion making it possible to secure said second part 2 in the body 1 by virtue of a snap-fitting process. The protrusion is made up of a volume of plastic materials helping to secure the second part 2 inside the body 1 by virtue of the elastic energy stored in said protrusion.

The use of the capsule 40, as depicted in FIG. 5, is discussed in detail hereinafter. As soon as a user wishes to use the container 110 according to the invention, he removes the protective cover 14 (if this protective cover is present) in order to access the flexible wall 24. With his finger, the user displaces the flexible wall 24 from its first position shown in FIG. 5 towards its second position in the direction of the dispenser 3. Since the striker 23 is secured on the flexible wall 24, said striker 23 is displaced in the direction of the frangible area 45 of the second wall 42 of the capsule 40. The displacement of the striker 23 continues until the frangible area 45 is fractured and the unit, composed of the fractured element of the second wall 42 and the striker 23, pierces the first wall or protective cover 41. At the end of this action, the separation between the first fluid 11 and the second fluid 21 disappears and the user can shake the container 10 and thus obtain a mixture of said fluids 11 and 21.

The technical result of using the capsule 40, as shown in FIG. 5, is that the second fluid 21 can be received and stored inside the container 110, while maintaining a distance between said second fluid 21 and the materials making up the flexible wall 24 and the striker 23. The choice of the material making up the capsule 40 can be finalised so as to be able to ensure its compatibility with the characteristics of the second fluid 21, the integrity of the container 110 therefore not being affected, neither during its transportation nor during its storage. It should be noted that, according to an embodiment of the invention, the free space, indicated under the reference 43 in FIG. 5, situated between the flexible wall 24 and the capsule 40, can be filled with the aid of a third fluid, said third fluid (not shown in FIG. 5) being able, for example, to be composed of a powder which can be mixed with the first fluid 11 and the second fluid 21, and this during or after the first manipulation of the flexible wall 24 in the direction of the outlet 31.

Figure 6:
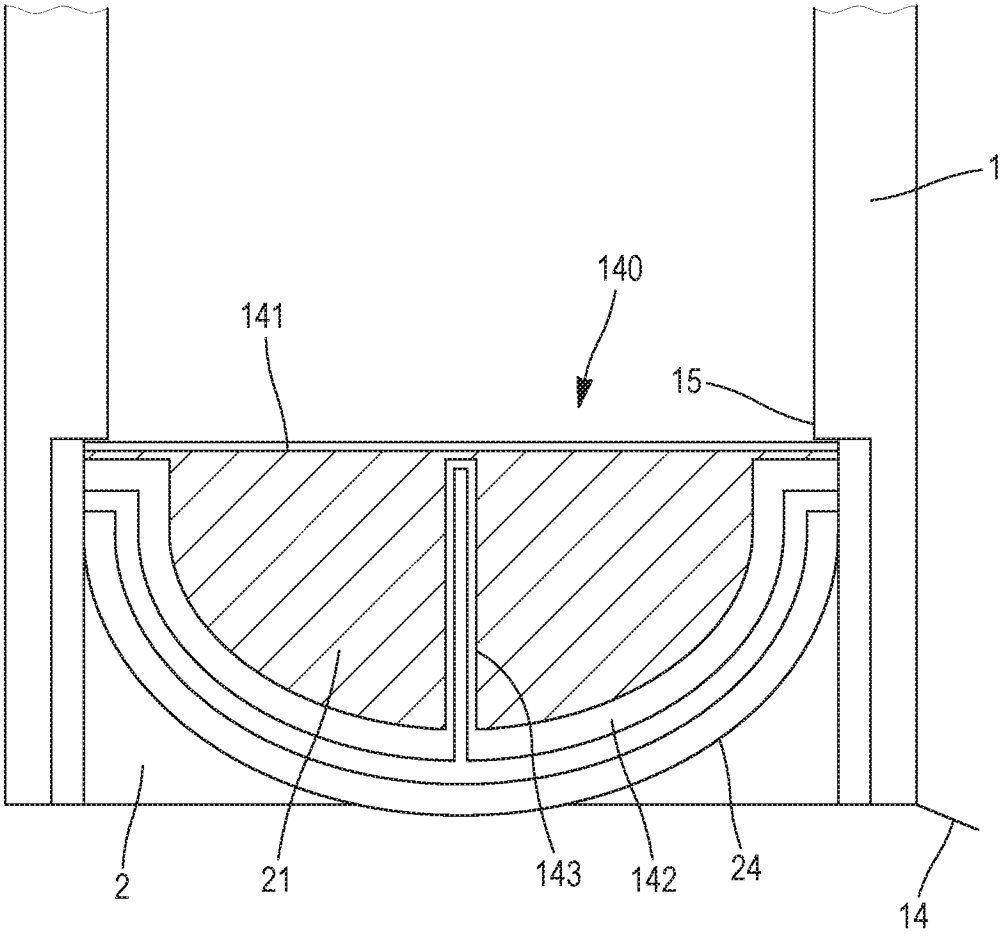
FIG. 6 depicts a schematic view of a second embodiment of the capsule according to the present invention.

FIG. 6 depicts an alternative embodiment of a capsule 140 according to the present invention. The capsule 140 comprises a first part or first wall 141, having substantially the form of a protective cover, and a second part or second wall 142, comprising a substantially convex-shaped wall, provided with a striker 143 at its centre. The capsule 140 is suitable for being received between the second part 2 and the body 1 (as shown in FIG. 5). For the securing of the capsule 140, the body 1 can be provided, in its inner wall, with a shoulder 15 making it possible to limit the insertion of the second part 2 towards the inside of the body 1 and to secure said capsule 140 between said shoulder 15 and said second part 2.

The selection of the materials, which are intended to produce the first part 141 and the second part 142 of the capsule 140, can be made so as to ensure their compatibility with the characteristics of the second fluid 21 held inside said capsule 140.

The functioning of the capsule 140, (as shown in FIG. 6), following assembly of said capsule 40 in a container, is as follows. First of all, the protective cover 14 is removed so as to make it possible to access the flexible wall 24. With the aid of his finger, the user can displace said flexible wall 24 from its initial position (as shown in FIG. 6) in the direction of the dispenser 3. The shape of the capsule 140 also makes it possible to displace the second part 142 in the direction of said dispenser 3. This means that the striker 143, situated inside the capsule 140, is displaced in the direction of the first part 141 of said capsule 140. When the displacement is effective, the end of said striker 143 pierces said first wall 141 of the capsule 140, thus releasing the second fluid 21 contained in said capsule 140. Once this action is completed, the user can then shake the container 10, thus mixing the first fluid 11, contained inside the body 1, and the second fluid 21, contained inside the capsule 140.

Referring to FIGS. 3-6, it should be noted that the material used for the first part 41, 141 of the capsule 40, 140 has a breaking-strength coefficient lower than that of the material of the second part 42, 142 of the capsule 40, 140.

It should be noted that the striker 23, 143 is positioned along the longitudinal central axis of the body 1 and makes it possible to open the capsule 40, 140 by piercing the central part of the second part 42, 142 of the capsule 40, 140, then the first part 41, 141 of the capsule 40, 140.

The invention claimed is:

1. A container (110) comprising a tubular body (1) forming a first volume for receiving a first fluid (11), said body (1) having a first (12) and a second end (13), said first end (12) comprising a dispenser (3) provided with an aperture (31) making it possible to dispense the contents of the container (110), said second end (13) comprising a closure element (2), the closure element (2) comprising a flexible wall (24) making it possible for said flexible wall (24) to be displaced between a first and a second position relative to said dispenser (3) in order to thus dispense the contents of the container (110), wherein the container (110) comprises a capsule (40, 140) forming a second volume for containing a second fluid (21), the capsule (40, 140) being positioned between the dispenser (3) and the flexible wall (24) respectively, the capsule (40, 140) being suitable for releasing the second fluid (21) into said first volume during or after a first displacement of said flexible wall (24), from its first position towards its second position, wherein the capsule (40, 140) comprises a first wall (41, 141), in the assembled position of the capsule (40, 140), facing the dispenser (3), and a second wall (42, 142), in the assembled position of the capsule (40, 140), facing the flexible wall (24) of the closure element (2) and wherein at least one part of the second wall (42, 142) of the capsule (40, 140) is provided with at least one frangible area.

2. The container (110) according to claim 1, wherein the closure element (2) is suitable for being secured to the inside of the tubular body (1), the body (1) having a shoulder (15) for limiting the insertion of the closure element (2) into said body (1), and wherein the capsule (40, 140) is suitable for being secured between said shoulder (15) and the closure element (2) respectively.

3. The container (110) according to claim 2, wherein the closure element (2) is secured in the body (1) by snap-fitting.

4. The container (110) according to claim 1, wherein the first wall (41, 141) of the capsule (40, 140) comprises a first material and wherein the second wall (42, 142) comprises a second material, different from the first material.

5. The container (110) according to claim 4, wherein the first material of the first wall (41, 141) of the capsule (40, 140) has a breaking-strength coefficient lower than that of the material of the second wall (42, 142) of the capsule.

6. The container (110) according to claim 1, wherein the container (110) is provided with a striker (23, 143) suitable for following the displacement of the flexible wall (24) from the first position of the flexible wall (24) towards the second position of the flexible wall (24) and suitable for opening the first (41, 141) and the second wall (42, 142) of the capsule (40, 140) during this displacement.

7. The container (110) according to claim 6, wherein the striker (23, 143) is secured on the flexible wall (24) and directed, in an assembled position of the striker (23, 143), to face the second wall (42, 142) of the capsule (40, 140).

8. A container (110) comprising a tubular body (1) forming a first volume for receiving a first fluid (11), said body (1) having a first (12) and a second end (13), said first end (12) comprising a dispenser (3) provided with an aperture (31) making it possible to dispense the contents of the container (110), said second end (13) comprising a closure element (2), the closure element (2) comprising a flexible wall (24) making it possible for said flexible wall (24) to be displaced between a first and a second position relative to said dispenser (3) in order to thus dispense the contents of the container (110), wherein the container (110) comprises a capsule (40, 140) forming a second volume for containing a second fluid (21), the capsule (40, 140) being positioned between the dispenser (3) and the flexible wall (24) respectively, the capsule (40, 140) being suitable for releasing the second fluid (21) into said first volume during or after a first displacement of said flexible wall (24), from its first position towards its second position, wherein the container (110) is provided with a striker (23, 143) suitable for following the displacement of the flexible wall (24) from the first position of the flexible wall (24) towards the second position of the flexible wall (24) and suitable for opening a first wall (41, 141) and a second wall (42, 142) of the capsule (40, 140) during this displacement and wherein the striker (143) is secured to the inside of the capsule (140) between the first (41, 141) and the second wall (142, 42) of the capsule (140).

9. A container (110) comprising a tubular body (1) forming a first volume for receiving a first fluid (11), said body (1) having a first (12) and a second end (13), said first end (12) comprising a dispenser (3) provided with an aperture (31) making it possible to dispense the contents of the container (110), said second end (13) comprising a closure element (2), the closure element (2) comprising a flexible wall (24) making it possible for said flexible wall (24) to be displaced between a first and a second position relative to said dispenser (3) in order to thus dispense the contents of the container (110), wherein the container (110) comprises a capsule (40, 140) forming a second volume for containing a second fluid (21), the capsule (40, 140) being positioned between the dispenser (3) and the flexible wall (24) respectively, the capsule (40, 140) being suitable for releasing the second fluid (21) into said first volume during or after a first displacement of said flexible wall (24), from its first position towards its second position, wherein the container (110) is provided with a striker (23, 143) suitable for following the displacement of the flexible wall (24) from the first position of the flexible wall (24) towards the second position of the flexible wall (24) and suitable for opening a first wall (41, 141) and a second wall (42, 142) of the capsule (40, 140) during this displacement, wherein the striker (23, 143) is secured on the flexible wall (24) and directed, in an assembled position of the striker (23, 143), to face the second wall (42, 142) of the capsule (40, 140), wherein the striker (23) is positioned on the longitudinal axis of the body (1) of the container (110), and wherein the capsule (40) has, in cross-section, the shape of a W, with an outer compartment (43) for filling a space around the striker (23) and a central cavity (44) suitable for cooperating with the striker (23).

* * * * *